US008177490B2

(12) United States Patent
Bouru

(10) Patent No.: US 8,177,490 B2
(45) Date of Patent: May 15, 2012

(54) CONTROL DEVICE OF VARIABLE PITCH VANES IN A TURBOMACHINE

(75) Inventor: Michel Andre Bouru, Montereau sur le Jard (FR)

(73) Assignee: SNECMA, Paris (FR)

( * ) Notice: Subject to any disclaimer, the term of this patent is extended or adjusted under 35 U.S.C. 154(b) by 521 days.

(21) Appl. No.: 12/405,601

(22) Filed: Mar. 17, 2009

(65) Prior Publication Data

US 2009/0238681 A1 Sep. 24, 2009

(30) Foreign Application Priority Data

Mar. 19, 2008 (FR) ..... 08 01501

(51) Int. Cl.
*F01D 17/00* (2006.01)

(52) U.S. Cl. ..... 415/160; 415/150

(58) Field of Classification Search ..... 415/148–167; 60/226.3

See application file for complete search history.

(56) References Cited

U.S. PATENT DOCUMENTS

| | | | | |
|---|---|---|---|---|
| 4,618,311 | A | 10/1986 | Miura et al. | |
| 4,720,237 | A * | 1/1988 | Weiner et al. | 415/150 |
| 4,890,977 | A * | 1/1990 | Tremaine et al. | 415/164 |

FOREIGN PATENT DOCUMENTS

| | | | |
|---|---|---|---|
| BE | 667796 | | 12/1965 |
| EP | 1 101 902 | A2 | 5/2001 |
| EP | 1101902 | * | 5/2001 |
| FR | 1 586 566 | | 2/1970 |

* cited by examiner

*Primary Examiner* — Steven Loke
*Assistant Examiner* — Victoria Hall
(74) *Attorney, Agent, or Firm* — Oblon, Spivak, McClelland, Maier & Neustadt, L.L.P.

(57) ABSTRACT

A control device of variable pitch vanes in a turbomachine is disclosed. The control device includes a ring surrounding a casing of the turbomachine and connected by links to the variable pitch vanes, and a jack connected to the ring in order to displace it in rotation around the casing. The jack is mounted pivoting on the casing and its piston rod is connected to the ring by a connecting rod. The piston and connecting rods are articulated on an axis which is connected to the casing by a guiding device maintaining it at a substantially constant distance from the casing.

9 Claims, 4 Drawing Sheets

CONTROL DEVICE OF VARIABLE PITCH VANES IN A TURBOMACHINE

BACKGROUND OF THE INVENTION

1. Field of the Invention

This invention relates to a device for controlling variable pitch vanes in a turbomachine, such as an aircraft turbojet or turboprop engine.

2. Description of the Related Art

A turbomachine includes one or several stages of variable pitch straightening vanes which are mounted between rotor wheels of a compressor. These variable pitch vanes are borne by the stator of the turbomachine and can be adjusted in position around their axes in order to optimize the gas flow in the engine of the turbomachine.

A variable pitch vane includes a cylindrical pivot at each of its ends, these pivots defining the axis of rotation of the vane. The radially external pivot is engaged in a cylindrical duct of a casing of the turbomachine and is connected by a link to a control ring driven in rotation around the casing by a jack. The rotation of the ring is transmitted by the links to the external pivots of the vanes and makes them rotate on their axes.

The piston rod of the jack can be connected directly to an articulation point on the ring. When the cylinder of the jack is mounted fixed on the casing of the turbomachine, the axis of the jack must be as tangential as possible to the ring, in order to limit the transverse forces applied on the rod of the jack during the displacement of the ring. The maximum admissible misalignment is +/−6° between the axis of the piston rod of the jack and a tangent to the ring, on the aforementioned articulation point, so that the transverse forces applied on the rod of the jack show less than about 10% of the axial force transmitted by the jack. It is therefore sometimes impossible to raise the jack in the immediate vicinity of the articulation point on the control ring, and therefore the rod of the jack must be connected to the control ring via a connecting rod. However, in this case, the misalignment of the axes of the jack and of the connecting rod can reach about 30°, and even more, which generates transverse forces that are too high on the rod of the jack during its displacements.

BRIEF SUMMARY OF THE INVENTION

The invention has in particular for purpose to provide a simple, effective and economical solution to the problems of current art, by authorizing the mounting of the jack at a distance from the articulation point on the control ring.

It proposes to this effect a control device of variable pitch vanes in a turbomachine, including a ring surrounding a casing of the turbomachine and connected by links to the variable pitch vanes, and a jack of which a piston rod is connected to the ring to displace it in rotation around the casing, the jack being mounted pivoting on the casing around an axis parallel to the axis of the casing, wherein the piston rod of the jack is connected to the ring by a connecting rod of which a first end is articulated on one end of the piston rod and a second end is articulated on the ring, around axes that are parallel to the axis of the casing, the axis of articulation of the end of the piston rod and of the first end of the connecting rod being guided in displacement by guiding means mounted on the casing in order to maintain it at a substantially constant distance from the casing.

According to the invention, the means of guiding fixed to the casing take up the transverse forces at the end of the piston rod connected to the connecting rod, in such a way that the angle between the piston rod and the connecting rod can be any angle. In addition, the means of guiding provide a uniqueness of position of the control ring for a given extension of the piston rod from the jack.

The invention furthermore makes it possible to mount the connecting rod in a perfectly tangential manner in relation to the ring, even if the misalignment between the axis of the jack and the connecting rod is 30° or more. The control device according to the invention can then be housed more easily in the annular space located between the casing and an external wall surrounding the casing and delimiting the passage stream of the secondary flow in the turbomachine.

The rod of the jack and the first end of the connecting rod can be mounted on the axis of articulation by swiveling systems. The cylinder of the jack can also be articulated on the casing by a swiveling system.

In an embodiment of the invention, the guiding means are mounted pivoting on the casing around an axis parallel to the axis of the casing. These guiding means are for example a rigid arm of which one end bears the axis of articulation of the ends of the piston rod and of the connecting rod, and of which the other end is mounted pivoting on the casing.

In another embodiment, the guiding means are fixed on the casing and include a guiding slot of the axis of articulation of the ends of the piston rod and of the connecting rod, this slot being substantially parallel to the cylindrical surface of the casing. The guiding slot can be rectilinear, or an arc of a circle centered on the axis of the casing.

The pivoting axis of the cylinder of the jack can be borne by supporting means fixed on the casing, these supporting means including for example two parallel lugs between which is arranged the cylinder of the jack. The jack is of the hydraulic, pneumatic, or electrical type.

The lugs for supporting the jack can also be connected between themselves and be formed of a single part, or be independent from one another. The ends of the pivoting axis of the jack are for example engaged in swiveling systems borne by these lugs.

The invention also relates to a turbomachine compressor, including at least one device such as described hereinabove, as well as a turbomachine, such as an aircraft turbojet or turboprop engine, comprising at least one device of the aforementioned type.

The invention shall be better understood and other characteristics, details and advantages of the invention shall appear when reading the following description given by way of non-limiting example and in reference to the annexed drawings wherein:

DETAILED DESCRIPTION OF THE INVENTION

Figure 1:
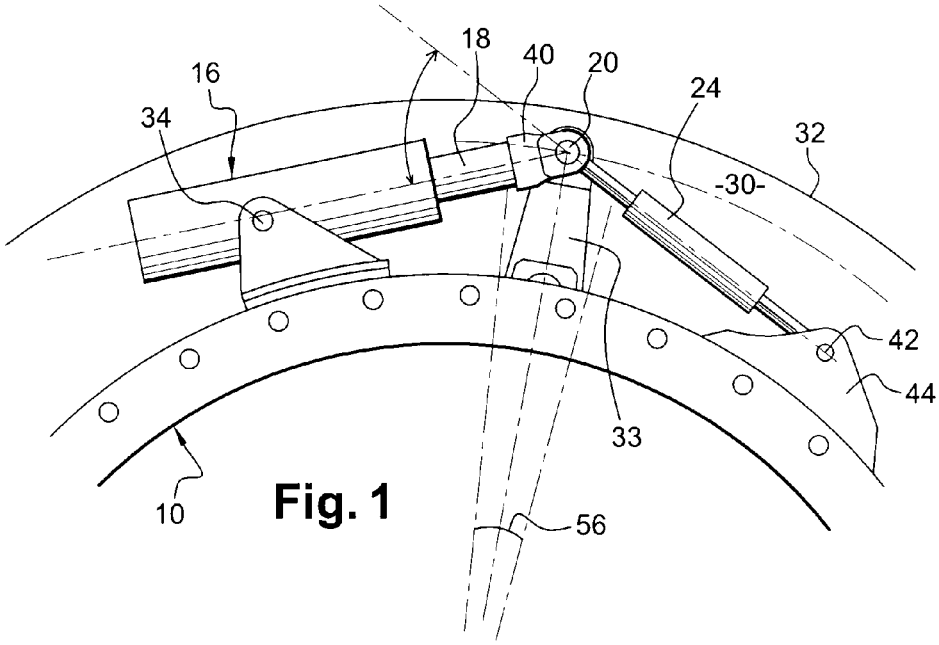
FIGS. 1 to 3 are perspective schematic views of a control device of variable pitch vanes according to the invention.
Figure 2:
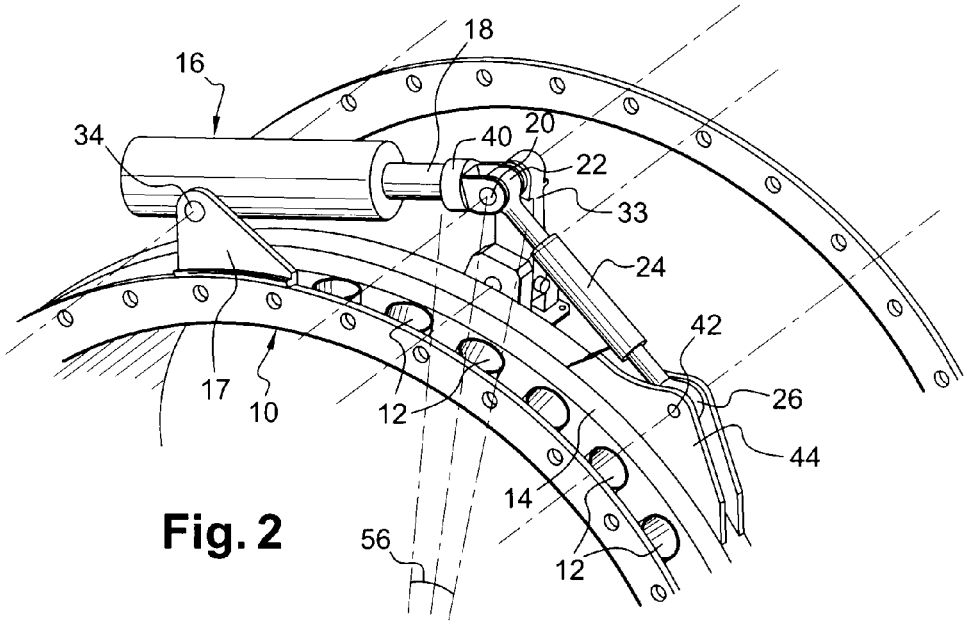
Figure 3:
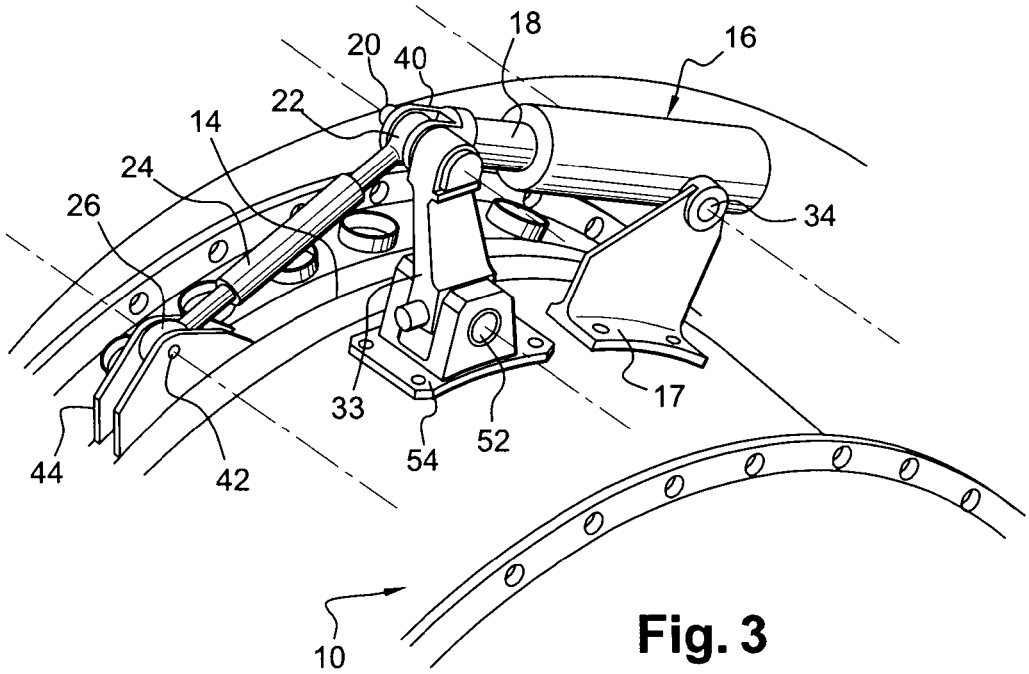

The control device of variable pitch vanes shown in FIGS. 1 to 4 is mounted on a substantially cylindrical casing 10 of a high-pressure compressor of a turbomachine such as an aircraft turbojet or turboprop engine.

The casing 10 bears one or several stages of variable pitch vanes which are not shown in the drawings, the vanes of one stage being distributed regularly around the revolving axis of the casing. In a known manner, each vane includes a blade connected at its radially external end to a radial cylindrical pivot which extends along the axis of rotation of the vane and which is engaged in a cylindrical duct 12 of the casing. The radially external end of this pivot is connected to the end of a link (not shown) of which the other end is connected to a ring 14 of the control device.

The ring 14 surrounds the casing 10 and can be displaced in rotation around the casing 10 by a jack 16 of the hydraulic, pneumatic or electrical type which is borne by supporting means 17 fixed on the casing 10. The piston rod 18 of the jack is connected by a connecting rod 24 to an axis of articulation 42 borne by a stirrup 44 of the ring, this axis 42 being parallel to the axis of the casing 10. The displacement of the piston rod 18 of the jack 16 drives an angular displacement of the ring 14 around the axis of the casing 10, which results in the driving in rotation of the variable pitch vanes around their axes, as shall be described in more detail in what follows.

As shown, the connecting rod 24 is substantially tangent to the ring. If the jack 16 were aligned tangentially to the ring 14 (on the axis of articulation 42), it would be distanced radially from the casing and would not be able to be housed in the annular space 30 defined by the casing 10 and an annular external wall 32 surrounding the casing 10 and delimiting interiorly the annular passage stream of the secondary flow in the turbomachine.

This invention makes it possible to overcome this problem thanks to connecting means the end of the piston rod 18 to the casing, these (connecting means 33 being intended to take up the transverse forces applied on the piston rod 18 of the jack during operation.

The jack 16 is articulated on the casing 10 around an axis 34 borne by the cylinder of jack and engaged in the corresponding orifices of the supporting means 17. This axis 34 is substantially perpendicular to the longitudinal axis of the jack 16 and parallel to the axis of the casing 10.

The means of supporting of the jack 16 is formed by lugs 17 which are fixed to their radially internal ends on the casing 10, and which include at their radially external ends bearing mounting orifices wherein are received the ends of the axis 34 of pivoting of the jack, when these mounting orifices are well aligned in relation to one another. Alternatively, the lugs 17 can bear swiveling systems wherein are received the ends of the axis 34, these swiveling systems being intended to recover any axial misalignment between the aforementioned orifices of the lugs 17.

These lugs 17 can be independent and fixed independently in relation to one another on the casing 10, for example by screws, or are part of a U-shaped bracket of which the median part is applied and fixed on the casing 10, for example by screws.

The piston rod 18 of the jack 16 includes at its free end a U-shaped stirrup 40 which bears an axis of articulation 20, this axis 20 being substantially parallel to the axis of the casing 10. The connecting rod 24 comprises a first end 22 engaged between the branches of the stirrup 40 of the jack 16 and articulated on the axis 20. The stirrup 40 of the jack 16 and the end 22 of the connecting rod 24 are mounted on the axis of articulation 20 by the intermediary of bearings or swiveling systems (not visible). The second end 26 of the connecting rod 24 is mounted pivoting on the axis 42 borne by the stirrup 44 of the ring 14.

The means of connecting to the casing are formed by a rigid arm 33 bearing at a first end 22 the axis of articulation 20 and mounted pivoting to a second end 26 on the casing 10, around an axis parallel to the axis of the casing 10.

Figure 4:
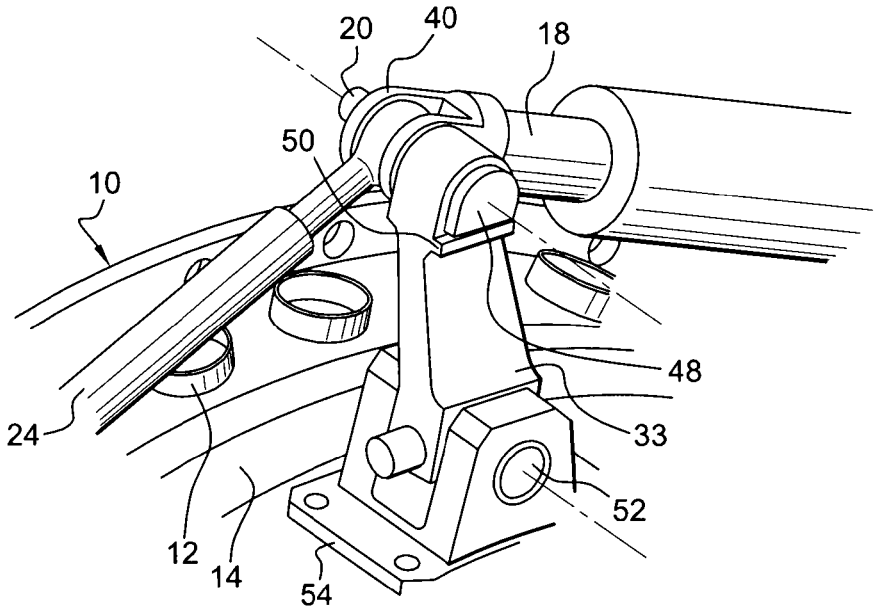
FIG. 4 is a view on a larger scale of a portion of FIG. 3, FIGS. 5 to 7 are perspective schematic views of an alternative embodiment of the control device of variable pitch vanes according to the invention.
Figure 5:
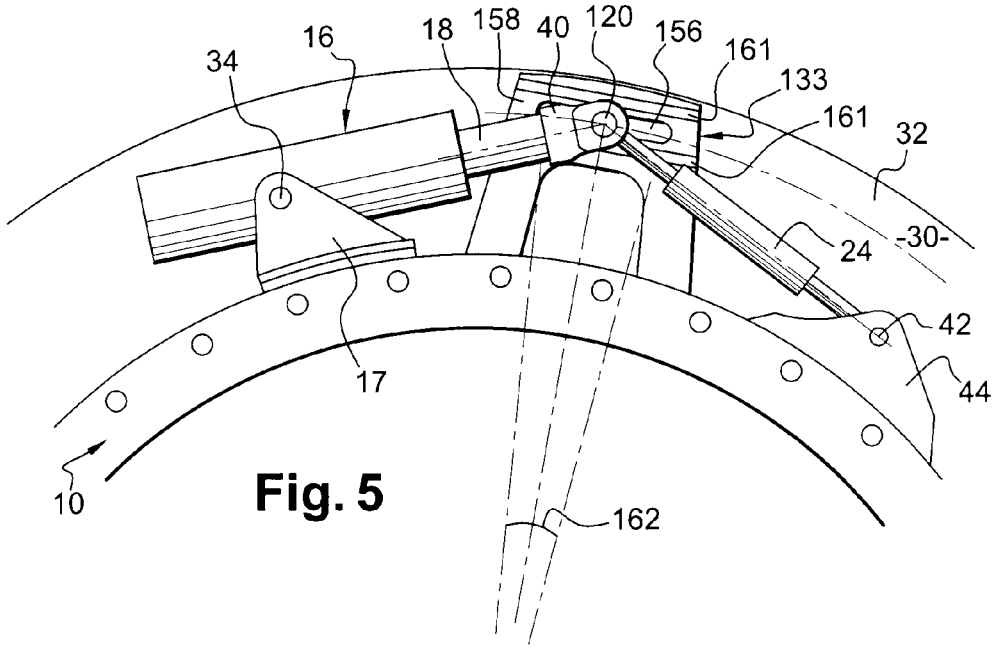

The first end of the arm 33 comprises a mounting orifice of the axis of articulation 20. This axis of articulation 20 includes a flat head 48 intended to be applied on a corresponding lateral face of the arm 33. The head 48 of the axis 20 comprises a flat cooperating by limit stop with a corresponding lip 50 of the arm in order to prevent the rotation of the axis 20 in the orifice of the arm 33 (FIG. 4).

The stirrup 40 of the rod of the jack 16 and the end 22 of the connecting rod pivot on the cylindrical portion of the axis of articulation 20 which includes on the side opposite the head 48 a threaded part receiving a clamping nut.

The second end of the arm 33 is mounted pivoting on an axis 52 borne by a stirrup 54 fixed on the casing 10, for example by screws. This axis 52 is parallel to the axis of articulation 20 and to the axis of the casing 10 (FIG. 4).

In the drawings, the arm 33 is in a position of intermediate pivoting wherein it extends substantially radially in relation to the axis of the casing 10. The angular displacement 28 of the arm 33 in relation to this intermediate position is for example of a magnitude of approximately +/−22,5° , which corresponds to an angular displacement 56 of the ring 14 of approximately +/−5° (reference 56 in FIG. 1).

The control device represented in FIGS. 1 to 4 operates in the following manner. The jack 16 is supplied in order to displace its piston rod 18 over a determined axial travel. The displacement of the rod of the jack is transformed into a rotation of the ring around the axis of the casing, with a pivoting of the arm 33 around the axis 52, and a pivoting of the jack 16 around the axis 34. The guide arm 33 transmits to the casing the radial forces applied to the end of the piston rod 18 during its displacements.

In the alternative embodiment shown in FIGS. 5 to 8, the control device differs from that of FIGS. 1 to 4 in particular by the form of the axis of articulation 120 and by the means 133 of connecting this axis of articulation to the casing.

These connecting means include a U-shaped member 133 fixed rigidly on the casing 10 and comprising a guiding slot 156 of the axis of articulation. The member 133 includes two lateral portions connected to one another by a median part and fixed at their ends, for example by screws, on the casing 10.

The median part of the member 133 extends substantially tangentially in relation to a circumference centered on the axis of the casing 10, and the slot 156 extends on a major portion of the length or of the dimension in a tangential direction of this median part.

The slot 156 here has a substantially rectilinear form in order to guide the axis of articulation 120 along a rectilinear trajectory. Alternatively, this slot can have the form of an arc of a circle centered on the axis of the casing 10.

The median part of the member 133 has in section a substantially I shape and comprises a central core 158 wherein is formed the slot 156.

Figure 6:
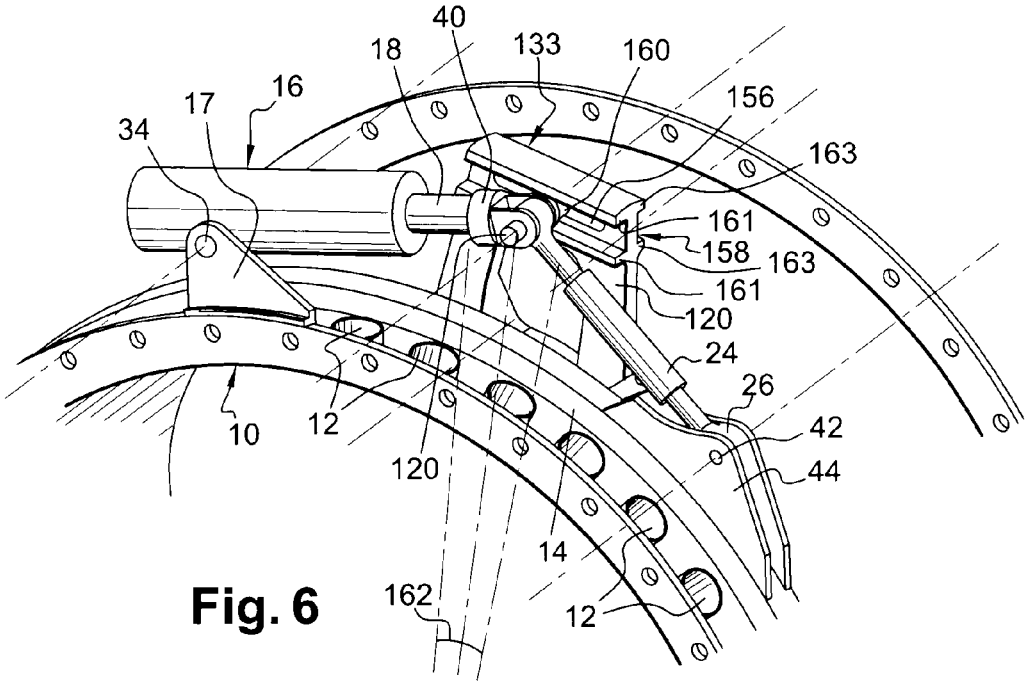
Figure 7:
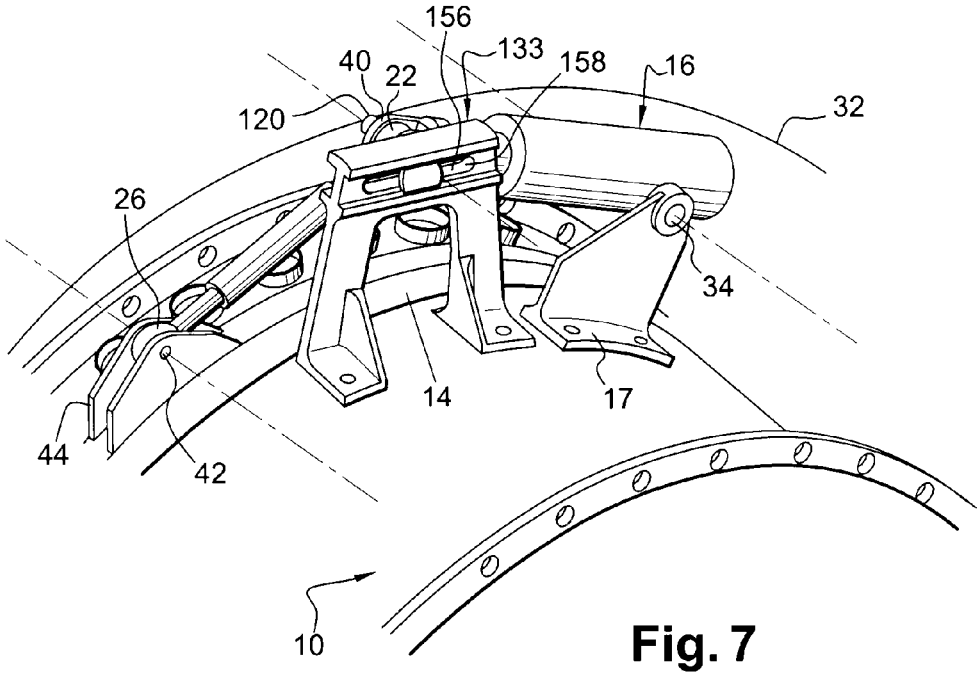
Figure 8:
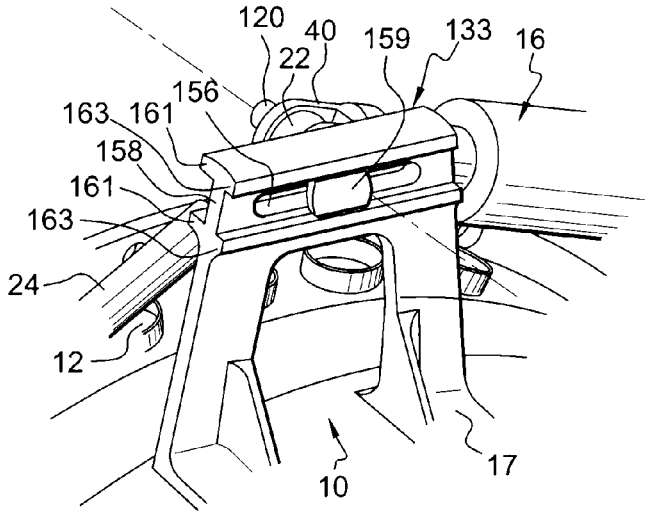
FIG. 8 is a view on a larger scale of a portion of FIG. 7.

The axis of articulation 120 includes at one end a flat head 159 intended to be applied on a corresponding lateral face of the member 133, this head 159 comprising flats cooperating by limit stop with the corresponding lips 163 of the member in order to prevent the rotation of the axis 120 in relation to the member. The axis 120 traverses the slot 156 and a bore of a guide nut 160 inserted between the stirrup 40 of the jack and the core 158 of the member. This nut 160 is mounted sliding between the rims 161 of the member 133 and is intended to cooperate by sliding with these rims 161 in order to provide the guiding of the axis of articulation 120 in the slot 156 (FIG. 6).

Alternatively, a second nut is traversed by the axis 120 and mounted between the flat head 159 of the axis 120 and the core 158 of the member. This second nut is housed between the lips 163 of which the axial dimension can be increased in relation to the example shown in such a way as to ensure the guiding of the second nut as well as the locking in rotation of the axis 120.

The guide nut 160 can be covered with an anti-friction coating or be constituted entirely of anti-friction material. Alternatively, it can be mounted between the rims 161 of the member 133 by the intermediary of roller bearings.

As in the embodiment of FIGS. 1 to 4, the stirrup 40 of the jack 16 and the end 22 of the connecting rod 24 are mounted pivoting on the cylindrical portion of the axis of articulation 120. This cylindrical portion includes at its end opposite the nut 160 a threaded part receiving a clamping nut.

In the drawings, the axis of articulation 120 is in an intermediate position in the middle of the slot of the member 133. The displacement in translation of the axis of articulation 120 in this slot shows an angular displacement of approximately 10° around the axis of the casing (reference 162 in FIG. 5).

The control device shown in FIGS. 5 to 8 operates in the following manner. The axial displacement of the piston rod 18 of the jack 16 causes a displacement of the connecting rod 24, and a rotation of the ring 14 around the axis of the casing 10. The displacement of the rod 18 also causes a rectilinear translation of the axis of articulation 120 in a direction that is substantially tangent to a circumference centered on the axis of the casing, with a sliding or a rolling of the guide nut 160 between the rims 161 of the member 133, with a pivoting of the jack 16 around the axis 34.

In an example of an embodiment, the course of displacement of the rod 18 of the jack 16 is of a magnitude of approximately 50-60 mm, and the angular displacement of the variable pitch vanes around their axes is about 70° (for a particular stage of vanes of which the angular displacement is relatively important).

The invention claimed is:

1. A control device of variable pitch vanes in a turbomachine, comprising:

a ring surrounding a casing of the turbomachine and connected by links to the variable pitch vanes; and a jack of which a piston rod is connected to the ring in order to displace the ring in rotation around the casing, the jack being mounted pivoting on the casing around a pivoting axis parallel to the axis of the casing, wherein the piston rod of the jack is connected to the ring by a connecting rod of which a first end is articulated on one end of the piston rod and a second end is articulated on the ring, around first and second axes of articulation parallel to the axis of the casing, the first axis of articulation of the end of the piston rod and of the first end of the connecting rod being guided in displacement by guiding means mounted on the casing in order to maintain the first axis of articulation at a substantially constant distance from the casing, and wherein the guiding means include a rigid arm of which one end bears the first axis of articulation of the end of the piston rod and of the first end of the connecting rod and of which the other end is mounted pivoting on the casing around an axis parallel to the axis of the casing.

2. The device set forth in claim 1, wherein the connecting rod is orientated tangentially in relation to the ring.

3. The device set forth in claim 1, wherein the piston rod and the first end of the connecting rod are mounted on the first axis of articulation by swiveling systems.

4. The device set forth in claim 1, wherein the second end of the connecting rod pivots on an axis borne by a stirrup of the ring.

5. The device set forth in claim 1, wherein the pivoting axis of the jack is borne by supporting means fixed on the casing, the supporting means including two parallel lugs between which is arranged a cylinder of the jack.

6. The device set forth in claim 5, wherein the lugs bear swiveling systems receiving the ends of the pivoting axis of the jack.

7. The device set forth in claim 1, wherein the jack is of the hydraulic, pneumatic, or electrical type.

8. A turbomachine compressor, comprising at least one device set forth in claim 1.

9. A turbomachine, comprising at least one device set forth in claim 1.

* * * * *